US009104127B2

(12) United States Patent
Yamaguchi et al.

(10) Patent No.: US 9,104,127 B2
(45) Date of Patent: Aug. 11, 2015

(54) IMAGE FORMING APPARATUS

(71) Applicants: Akinori Yamaguchi, Osaka (JP); Hiroaki Ikeda, Osaka (JP); Tomohiro Ohshima, Osaka (JP); Masayuki Hayashi, Osaka (JP); Tatsuya Miyadera, Kanagawa (JP); Motohiro Kawanabe, Osaka (JP); Yoshinori Shirasaki, Osaka (JP)

(72) Inventors: Akinori Yamaguchi, Osaka (JP); Hiroaki Ikeda, Osaka (JP); Tomohiro Ohshima, Osaka (JP); Masayuki Hayashi, Osaka (JP); Tatsuya Miyadera, Kanagawa (JP); Motohiro Kawanabe, Osaka (JP); Yoshinori Shirasaki, Osaka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 13/917,874

(22) Filed: Jun. 14, 2013

(65) Prior Publication Data

US 2013/0343775 A1 Dec. 26, 2013

(30) Foreign Application Priority Data

Jun. 25, 2012 (JP) ..... 2012-142169

(51) Int. Cl.
*G03G 15/00* (2006.01)
*G03G 15/01* (2006.01)

(52) U.S. Cl.
CPC ..... *G03G 15/01* (2013.01); *G03G 15/5054* (2013.01); *G03G 15/505* (2013.01); *G03G 15/5008* (2013.01); *G03G 2215/00569* (2013.01); *G03G 2215/00599* (2013.01); *G03G 2215/00949* (2013.01)

(58) Field of Classification Search
CPC ..... G03G 15/5058
See application file for complete search history.

(56) References Cited

U.S. PATENT DOCUMENTS

| | | | | |
|---|---|---|---|---|
| 7,493,072 | B2 * | 2/2009 | Sato et al. | 399/301 |
| 7,538,918 | B2 * | 5/2009 | Oki | 358/521 |
| 2002/0025179 | A1 * | 2/2002 | Toyohara et al. | 399/49 |
| 2005/0009351 | A1 | 1/2005 | Takahashi et al. | |
| 2009/0073469 | A1 * | 3/2009 | Kita et al. | 358/1.9 |
| 2010/0226694 | A1 * | 9/2010 | Osawa et al. | 399/301 |
| 2012/0163843 | A1 * | 6/2012 | Murayama | 399/49 |

FOREIGN PATENT DOCUMENTS

| | | |
|---|---|---|
| JP | 2005-031263 | 2/2005 |
| JP | 2010-039071 | 2/2010 |

* cited by examiner

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

An image forming apparatus comprises: an image forming unit configured to form an image quality adjustment pattern image on an image carrier to be driven at a predetermined speed; a detector configured to detect the image quality adjustment pattern image; an image quality adjustment controller configured to control image quality adjustment processing in accordance with a detection result by the detector; a speed change unit configured to change an image formation speed indicating a speed at which an image is formed, and an interval change unit configured to change an interval at which the detector acquires a detection result in accordance with a change amount between the image formation speed before changed by the speed change unit and the image formation speed after changed.

9 Claims, 12 Drawing Sheets

IMAGE FORMING APPARATUS

CROSS-REFERENCE TO RELATED APPLICATIONS

The present application claims priority to and incorporates by reference the entire contents of Japanese Patent Application No. 2012-142169 filed in Japan on Jun. 25, 2012.

BACKGROUND OF THE INVENTION

1. Field of the Invention

The present invention relates to an image forming apparatus.

2. Description of the Related Art

In an electrophotography image forming apparatus, the following method has been known as a method of correcting transfer positional deviations (hereinafter, referred to as "positional deviation" or "color deviation" in some cases) for respective colors, for example. That is, known has been a method of forming a positional deviation correction pattern on an image carrier such as a carriage belt and an intermediate transfer member for conveying a recording medium such as a sheet and detecting positional information of the positional deviation correction pattern formed on the image carrier with a sensor so as to correct the positional deviations based on the detected positional information.

For example, Japanese Patent Application Laid-open No. 2005-031263 discloses the following technique in order to correct a positional deviation normally. That is, disclosed is a technique of using a mode A and a mode B as the situation demands. In the mode A, the positional deviation is corrected by using a positional deviation correction pattern having a normal size. In the mode B, the positional deviation is corrected by using a positional deviation correction pattern having a size and an interval that are larger than those in the mode A such that a sensor detects the positional deviation correction pattern even if the positional deviation is large.

Furthermore, the following method has been already known in order to detect a plurality of positional deviation correction patterns at high speed and with high accuracy. That is, known has been a method of generating interrupt on a central processing unit (CPU) so as to store a detection result (acquire a detection result) in a memory if the predetermined number of positional deviation correction patterns are detected by a sensor.

In the conventional positional deviation correction method using the interrupt on the CPU, an interrupt interval (interval at which the sensor acquires a detection result) until subsequent interrupt is generated from generation of one interrupt depends on a cycle (sampling cycle) in which the predetermined number of pieces of data (A/D-converted data) obtained by converting an analog signal output from the sensor to a digital signal are sampled. Because the sampling cycle relates to various functions such as resolution based on a filter characteristic and a clock, the sampling cycle cannot be changed easily. If an image formation speed is changed in a state where the sampling cycle is constant, the following problem arises in the technique disclosed in Japanese Patent Application Laid-open No. 2005-031263. That is, there arises the problem that the positional deviation correction pattern is not within an expected interrupt interval and cannot be detected normally. In addition, the same problem also arises in a method of correcting densities of respective colors by using a density deviation correction pattern.

There is need to provide an image forming apparatus that can detect an image quality adjustment pattern image normally even if an image formation speed is changed.

SUMMARY OF THE INVENTION

It is an object of the present invention to at least partially solve the problems in the conventional technology.

According to the present invention, there is provided: an image forming apparatus comprising: an image forming unit configured to form an image quality adjustment pattern image on an image carrier to be driven at a predetermined speed; a detector configured to detect the image quality adjustment pattern image; an image quality adjustment controller configured to control image quality adjustment processing in accordance with a detection result by the detector; a speed change unit configured to change an image formation speed indicating a speed at which an image is formed, and an interval change unit configured to change an interval at which the detector acquires a detection result in accordance with a change amount between the image formation speed before changed by the speed change unit and the image formation speed after changed.

The present invention also provides an image forming apparatus comprising: an image forming unit configured to form an image quality adjustment pattern image on an image carrier to be driven at a predetermined speed; a detector configured to detect the image quality adjustment pattern image; an image quality adjustment controller configured to control image quality adjustment processing in accordance with a detection result by the detector; a speed change unit configured to change an image formation speed indicating a speed at which an image is formed, and a size change unit configured to change a size of the image quality adjustment pattern image in a sub-scanning direction in accordance with a change amount between the image formation speed before changed by the speed change unit and the image formation speed after changed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, described are embodiments of an image forming apparatus according to the present invention in detail with reference to the accompanying drawings. The image forming apparatus according to the invention can be applied to apparatuses that form an image by electrophotography. For example, the image forming apparatus according to the invention can be also applied to an electrophotography image forming apparatus, an electrophotography multifunction peripheral (MFP), and the like. It is to be noted that the multifunctional peripheral is an apparatus having at least two functions of a printing function, a copying function, a scanner function, and a facsimile function.

First Embodiment

Figure 1:
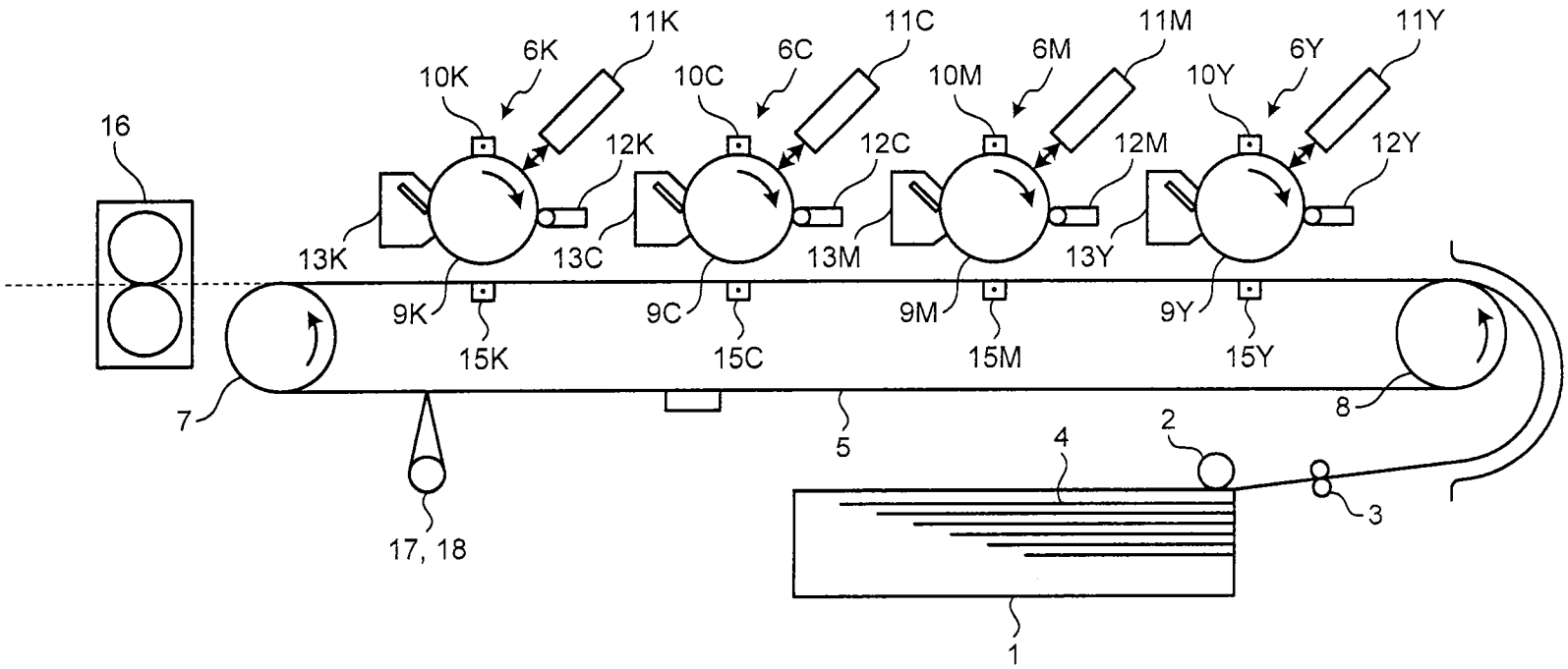
FIG. 1 is a view mainly illustrating a configuration example of parts on which an image is formed in an image forming apparatus according to an embodiment of the present invention.

FIG. 1 is a view mainly illustrating a configuration example of parts on which an image is formed in an image forming apparatus 100 according to the embodiment. The image forming apparatus 100 according to the embodiment has a configuration in which an image forming unit (electrophotography processing unit) 6C, an image forming unit 6M, an image forming unit 6Y, and an image forming unit 6K are aligned along a carriage belt as an endless moving unit 5 and is called as a what-is-called tandem type image forming apparatus. The image forming unit 6C forms an image of a color of cyan (C). The image forming unit 6M forms an image of a color of magenta (M). The image forming unit 6Y forms an image of a color of yellow (Y). The image forming unit 6K forms an image of a color of black (K). Hereinafter, when the respective image forming units 6Y, 6M, 6C, and 6K are not distinguished from one another, they are expressed as "image forming unit 6" simply in some cases. The image forming apparatus 100 according to the embodiment employs a system in which images are transferred directly onto a recording medium such as a sheet from photosensitive drums exposed to light in accordance with image data.

As illustrated in FIG. 1, the image forming units 6Y, 6M, 6C, and 6K are aligned along the carriage belt 5 in this order from the upstream side in the conveyance direction of the carriage belt 5. The carriage belt 5 conveys a sheet 4 to be separated and fed by a paper feeding roller 2 and a separation roller 3 from a paper feed tray 1. The image forming units 6Y, 6M, 6C, and 6K have a common internal configuration other than colors of toner images to be formed by them. In the following description, the image forming unit 6Y is described in detail. Because the configurations of the other image forming units 6M, 6C, and 6K are the same as that of the image forming unit 6Y, constituent components of the image forming units 6M, 6C, and 6K are illustrated in the drawings while being denoted with reference numerals distinguished by adding M, C, and K instead of Y denoting the constituent components of the image forming unit 6Y only and description thereof is omitted.

The carriage belt 5 is an endless belt wound over a driving roller 7 and a driven roller 8 that are driven rotationally. The driving roller 7 is driven rotationally by a driving motor (not illustrated). The driving motor, the driving roller 7, and the driven roller 8 function as driving units that move the carriage belt 5 as the endless moving unit. When an image is formed, the sheets 4 accommodated in the paper feed tray 1 are fed out in the order from the uppermost sheet. The sheet 4 is adsorbed to the carriage belt 5 with an electrostatic adsorption action and is conveyed to the first image forming unit 6Y by the carriage belt 5 that is driven rotationally. A toner image of yellow is transferred onto the sheet 4 on the image forming unit 6Y.

As illustrated in FIG. 1, the image forming unit 6Y is configured by including a photosensitive drum 9Y as a photosensitive element, a charger 10Y, an LEDA head 11Y, a developing unit 12Y, a photosensitive element cleaner (not illustrated), and a neutralization unit 13Y that are arranged around the photosensitive drum 9Y. The LEDA head 11Y is configured so as to expose the photosensitive drum 9Y to light.

When an image is formed, the outer circumferential surface of the photosensitive drum 9Y is charged uniformly by the charger 10Y in the dark, and then, is exposed to irradiation light corresponding to a yellow image from the LEDA head 11Y. With this, an electrostatic latent image is formed on the outer circumferential surface of the photosensitive drum 9Y. The developing unit 12Y makes the electrostatic latent image be a visible image with toner of yellow. This forms a toner image of yellow on the photosensitive drum 9Y. The toner image of yellow formed on the photosensitive drum 9Y is transferred onto the sheet 4 with an action of a transfer unit 15Y at a position (transfer position) at which the photosensitive drum 9Y makes contact with the sheet 4 on the carriage belt 5. This transfer forms an image with the toner of yellow on the sheet 4. Unnecessary toner remaining on the outer circumferential surface of the photosensitive drum 9Y that has transferred the toner image is wiped away by the photosensitive element cleaner. Thereafter, the photosensitive drum 9Y is neutralized by the neutralization unit 13Y and is in a stand-by state for subsequent image formation.

As described above, the sheet 4 onto which the toner image of yellow has been transferred on the image forming unit 6Y is conveyed to the subsequent image forming unit 6M by the carriage belt 5. A toner image of magenta is formed on a photosensitive drum 9M by the same process as the image formation process on the image forming unit 6Y and the toner image of magenta is transferred onto the toner image of yellow formed on the sheet 4 in a superimposed manner. The sheet 4 is further conveyed to the subsequent image forming units 6C and 6K. A toner image of cyan formed on a photosensitive drum 9C and a toner image of black formed on a photosensitive drum 9K are sequentially transferred onto the sheet 4 in the superimposed manner with the same operations. Thus, a full-color image is formed on the sheet 4. That is to say, in the example in FIG. 1, the image forming units 6 form a plurality of images on the recording medium (sheet 4) driven at a predetermined speed in the superimposed manner. The sheet 4 on which the full-color superimposed image has been formed is stripped from the carriage belt 5 and is fed to a fixing unit 16. The fixing unit 16 fixes the superimposed image onto the sheet 4 by applying heat and pressure thereto. The sheet 4 onto which the image has been fixed is discharged to the outside of the image forming apparatus 100.

In the above-mentioned electrophotography image forming apparatus, if the transfer positions for the respective colors are deviated, the toner images of the respective colors are not superimposed accurately, resulting in lowering of image quality of a print image. For solving this, deviations of the transfer positions for the respective colors need to be corrected (positional deviations of images of the respective colors need to be corrected). The image forming apparatus 100 according to the embodiment forms a positional deviation correction pattern image on the carriage belt 5 as the image carrier for correcting the positional deviations. Detail modes of the positional deviation correction pattern image will be described later. Sensors 17 and 18 are provided at the downstream side of the photosensitive drums (9Y, 9M, 9C, and 9K) (at the downstream side in the driving direction of the carriage belt 5). The sensors 17 and 18 detect the positional deviation correction pattern image formed on the carriage belt 5.

Each of the sensors 17 and 18 is configured by a light reflection-type sensor such as a TM sensor and includes a light source that outputs light beams toward a detection target and a light detecting element that detects reflected light from the detection target. In the example of FIG. 1, the sensors 17 and 18 are arranged so as to be aligned in the direction (main-scanning direction) orthogonal to the driving direction of the carriage belt 5 (conveyance direction, sub-scanning direction). Although the two sensors (17, 18) are arranged along the main-scanning direction in the embodiment, the number and the positions of the sensors for detecting the positional deviation correction pattern image can be changed arbitrarily.

Although the embodiment describes an image forming apparatus employing a system in which an image is transferred directly onto a recording medium as illustrated in FIG. 1, the image forming apparatus is not limited thereto. For example, as illustrated in FIG. 2, an image forming apparatus employing a system in which toner images formed on an intermediate transfer belt (the endless moving unit) 5 are transferred onto a recording medium such as the sheet 4 may be employed.

Figure 2:
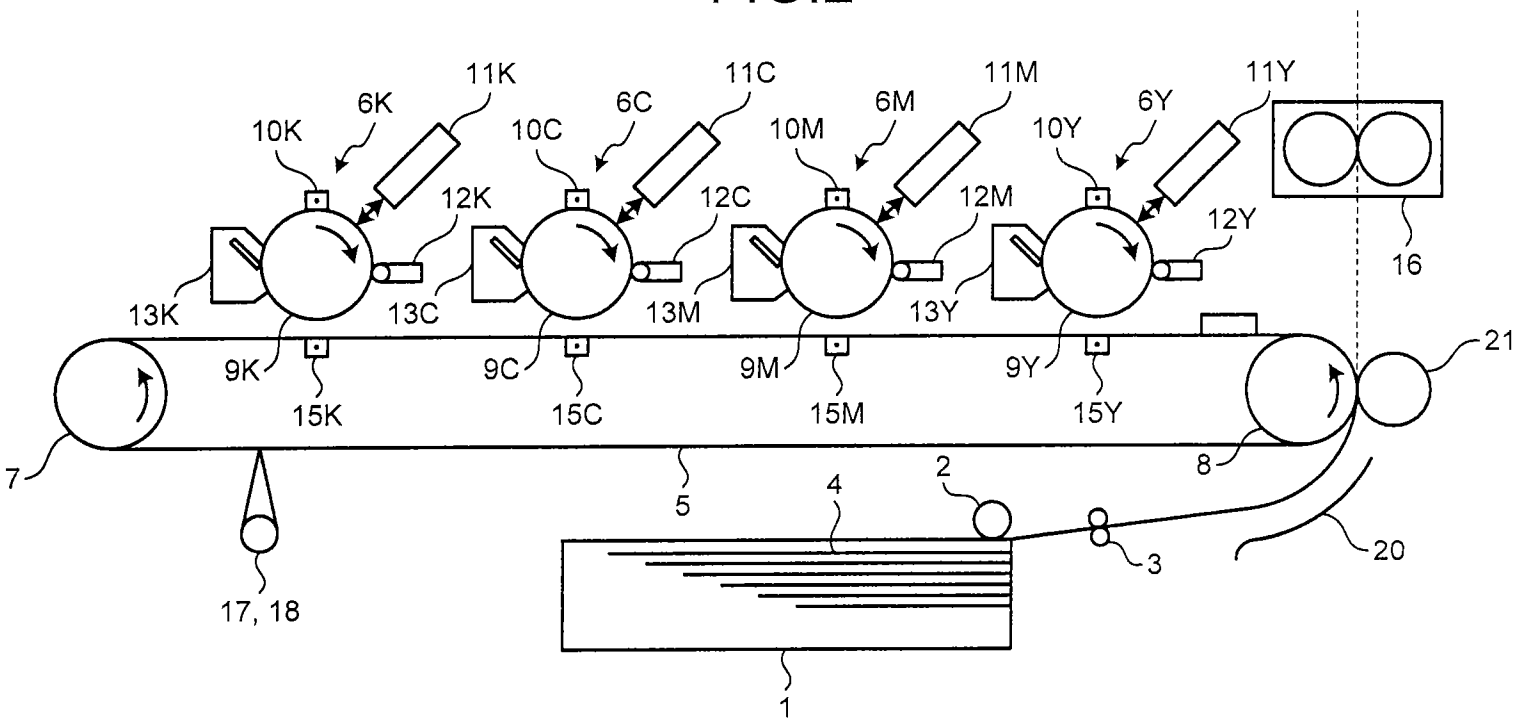
FIG. 2 is a view mainly illustrating a configuration example of parts on which an image is formed in an image forming apparatus according to a modification example.

In the example of FIG. 2, the endless moving unit 5 is not a carriage belt but the intermediate transfer belt. The intermediate transfer belt 5 is an endless belt wound over the driving roller 7 and the driven roller 8 that are driven rotationally. The toner images of the respective colors are transferred onto the intermediate transfer belt 5 by actions of the transfer units 15Y, 15M, 15C and 15K at the positions (primary transfer positions) at which the photosensitive drums 9Y, 9M, 9C, and 9K make contact with the intermediate transfer belt 5. This transfer forms a full-color image on which the toner images of the respective colors have been superimposed on the intermediate transfer belt 5. That is to say, in the example of FIG. 2, the image forming units 6 form the images of the colors on the image carrier (intermediate transfer belt 5) driven at the predetermined speed in a superimposed manner. When an image is formed, the sheets 4 accommodated in the paper feed tray 1 are fed out in the order from the uppermost sheet to be conveyed on the intermediate transfer belt 5. A full-color toner image formed on the intermediate transfer belt 5 is transferred onto the sheet 4 at a position (secondary transfer position 20) at which the intermediate transfer belt 5 makes contact with the sheet 4 with an action of a secondary transfer roller 21. The secondary transfer roller 21 makes close contact with the intermediate transfer belt 5 and has no contact/separation mechanism. In this manner, a full-color image is formed on the sheet 4. The sheet 4 on which the full-color superimposed image has been formed is fed to the fixing unit 16. Then, the sheet 4 onto which the image has been fixed by the fixing unit 16 is discharged to the outside of the image forming apparatus.

In the example of FIG. 2, a positional deviation correction pattern image is formed on the intermediate transfer belt 5 as the image carrier for correcting positional deviations. The sensors 17 and 18 are provided at the downstream side of the photosensitive drums (9Y, 9M, 9C, 9K) (at the downstream side in the driving direction of the intermediate transfer belt 5). The sensors 17 and 18 detect the positional deviation correction pattern image formed on the intermediate transfer belt 5.

Figure 3:
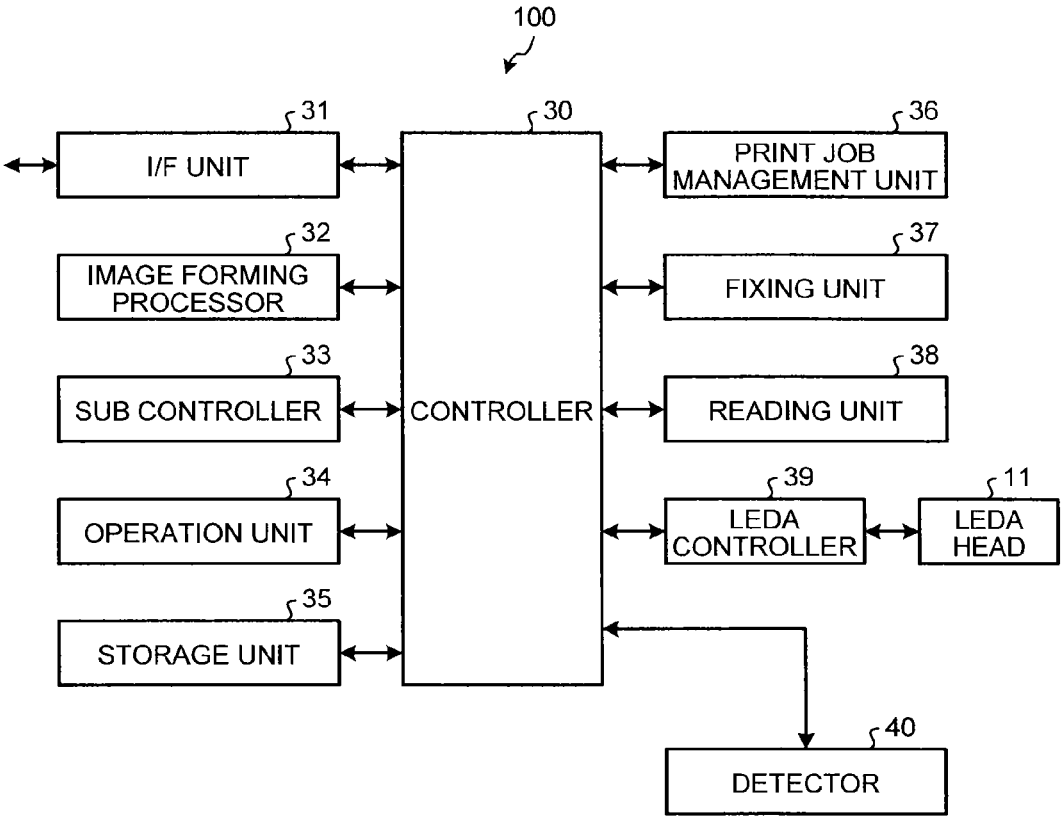
FIG. 3 is a functional block diagram illustrating a configuration example for controlling the image forming apparatus according to the embodiment.

FIG. 3 is a functional block diagram illustrating a configuration example for controlling the image forming apparatus 100 according to the embodiment. As illustrated in FIG. 3, the image forming apparatus 100 includes a controller 30, an interface (I/F) unit 31, an image forming processor 32, a sub controller 33, an operation unit 34, a storage unit 35, a print job management unit 36, a fixing unit 37, a reading unit 38, an LEDA controller 39, and a detector 40.

The controller 30 includes a central processing unit (CPU), a read only memory (ROM), and a random access memory (RAM), for example. The controller 30 controls the image forming apparatus 100 overall in accordance with computer programs previously stored in the ROM by using the RAM as a work memory. Furthermore, the controller 30 includes an adjusting unit that adjusts data transfer on a bus and controls the data transfer among the above-mentioned parts.

The I/F unit 31 is connected to an external device such as a personal computer (PC) and controls communication with the external device in accordance with a direction from the controller 30. For example, the I/F unit 31 receives a print request and the like transmitted from the external device and delivers them to the controller 30. The print job management unit 36 manages the printing order and the like for the print request (print job) requested to the image forming apparatus.

The sub controller 33 includes a CPU, for example, and controls the respective parts as illustrated in FIG. 1 in accordance with the print request. In addition, the sub controller 33 delivers image data for printing that has been transmitted from the external device through the I/F unit 31 to the LEDA controller 39.

The LEDA controller 39 receives the image data from the sub controller 33 and controls optical writing, that is, exposure onto the photosensitive drums 9Y, 9M, 9C, and 9K based on the image data by the above-mentioned respective LEDA heads 11Y, 11M, 11C, and 11K, respectively. Hereinafter, when the LEDA heads 11Y, 11M, 11C, and 11K are not distinguished from one another, they are referred to as "LEDA head 11" simply in some cases. The LEDA heads 11 are connected to the LEDA controller 39.

The image forming processor 32 includes the above-mentioned image forming units 6Y, 6M, 6C, and 6K and performs pieces of processing such as development and transfer of the electrostatic latent images written into the respective photosensitive drums 9Y, 9M, 9C, and 9K by the LEDA controller 39.

The detector 40 includes the above-mentioned sensors 17 and 18 and performs detection processing of the positional deviation correction pattern image formed on the carriage belt 5 by the image forming units 6 based on the signals output from the respective sensors 17 and 18. In the embodiment, the detector 40 includes an amplifier (not illustrated), a filter, an A/D converter, and an FIFO memory. The amplifier amplifies the signals output from the respective sensors 17 and 18, the filter extracts only signal components for line detection, and the A/D converter converts analog data to digital data. Under control by the controller 30, the predetermined number of pieces of data (detection result by the detector 40) obtained by A/D conversion are sampled to be stored in the FIFO memory every constant sampling cycle.

The storage unit 35 stores information indicating a state of the image forming apparatus 100 at one time point. For example, the storage unit 35 stores the detection result of the positional deviation correction pattern image by the detector 40 in accordance with interrupt generated by the controller 30. In the embodiment, the timing at which the detection result stored in the FIFO memory of the detector 40 is loaded on the storage unit 35 is defined by the timing of the generation of the interrupt. An interrupt interval until subsequent interrupt is generated from the generation of one interrupt can be also grasped as an interval at which the detector 40 acquires the detection result (the detection result stored in the FIFO memory of the detector 40 is loaded on the storage unit 35). The controller 30 controls the positional deviation correction processing by the LEDA controller 39 based on the acquired detection result. The operation unit 34 includes an operator that receives a user operation and a display unit that displays the state of the image forming apparatus 100 for the user.

The fixing unit 37 includes the above-mentioned fixing unit 16 and a configuration for controlling the fixing unit 16. The fixing unit 37 performs processing of fixing the toner image onto the sheet 4 by applying heat and pressure to the sheet 4 onto which the toner image has been transferred by the image forming processor 32.

The reading unit 38 reads print information on the sheet 4 and converts it to an electric signal so as to function as a what-is-called scanner function. The electric signal that the reading unit 38 has read and output the print information is delivered to the controller 30. The reading unit 38 and a communication unit (not illustrated) enables the image forming apparatus 100 to function as a multifunction peripheral serving as a printer function, a scanner function, a copying function, and a facsimile function with one housing. It is to be noted that the reading unit 38 can be omitted.

Figure 4:
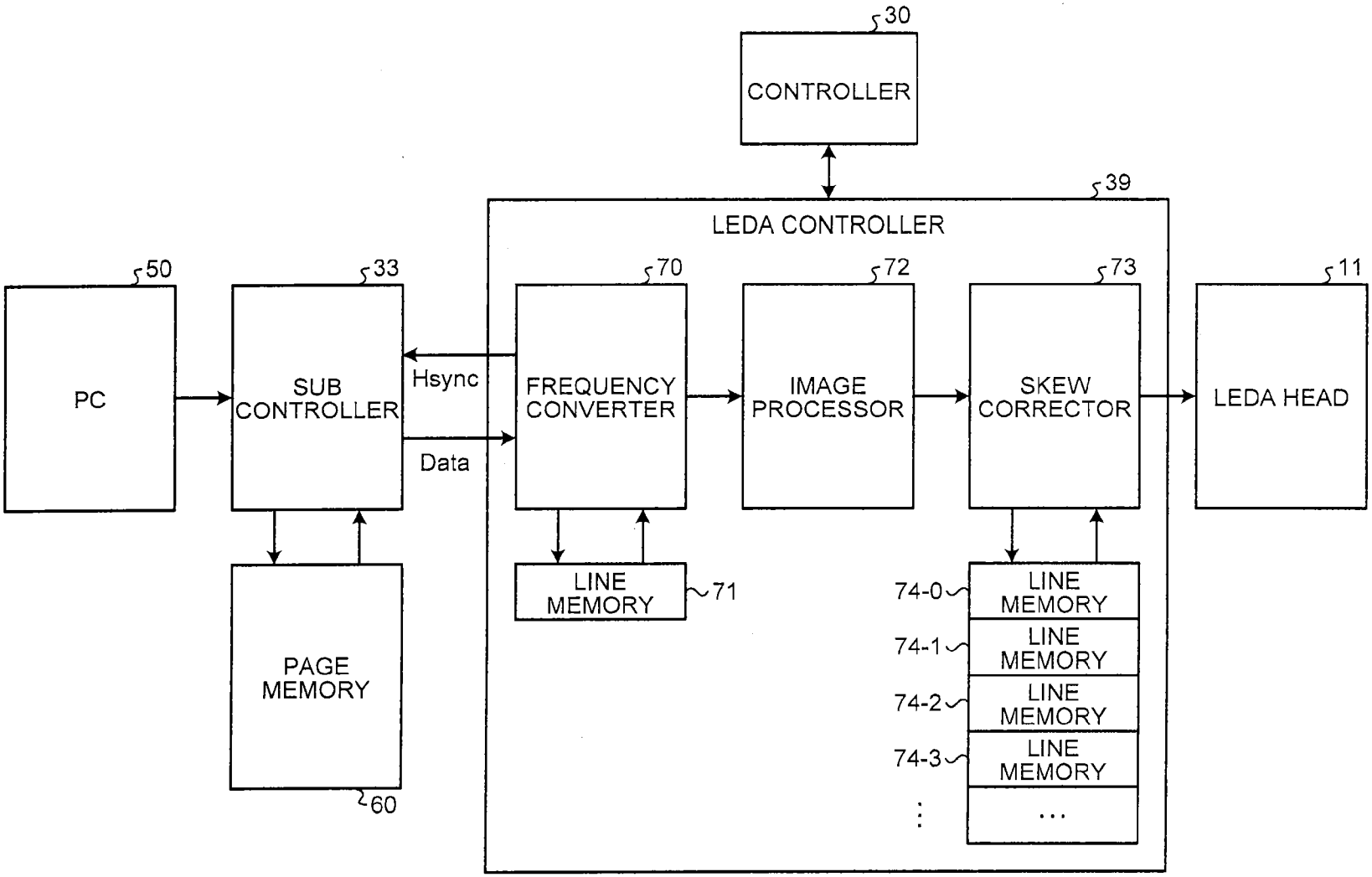
FIG. 4 is a diagram for explaining an example of detail functions of an LEDA controller.

FIG. 4 is a diagram for explaining an example of detail functions of the LEDA controller 39. The sub controller 33 receives print data generated by a PC 50 (printer driver installed on the PC 50) through a network (not illustrated). It is to be noted that the print data is described by a page description language (PDL), for example. The sub controller 33 converts the received print data to image data (for example, bit map data) constituted by a plurality of pixels on a page memory 60 and transfers it to the LEDA controller 39 line by line. To be more specific, the sub controller 33 transfers the image data to the LEDA controller 39 in accordance with an output timing of an HSYNC signal to be output from the LEDA controller 39 to the sub controller 33. The transfer mode includes an image formation mode in which different formats can be processed on a plurality-of-channels (CHs) basis and an image formation mode in which only a common format is processed among channels.

The LEDA controller 39 causes the LEDA heads 11 to emit light and form electrostatic latent images based on the image data transferred from the sub controller 33 line by line. That is to say, the LEDA controller 39 handles the image data transferred from the sub controller 33 as light emission data. The LEDA controller 39 includes a frequency converter 70, a line memory 71, an image processor 72, a skew corrector 73, and line memories 74-0 to 74-I (I is a natural number of equal to or larger than 2).

The sub controller 33 and the LEDA controller 39 have different operation clock frequencies. For this reason, the frequency converter 70 records the image data transferred from the sub controller 33 line by line in the line memory 71 sequentially and reads out the recorded image data sequentially based on the operation clock of the LEDA controller 39 so as to perform frequency conversion and transfer it to the image processor 72 line by line.

The image processor 72 performs image processing on the image data transferred from the frequency converter 70 line by line and transfers it to the skew corrector 73 line by line. The image processing includes processing of adding an internal pattern and trimming processing, for example. Furthermore, the image processor 72 performs positional deviation correction based on an input resolution unit at the same time as the above-mentioned image processing under control by the controller 30. When the image processor 72 performs processing requiring a line memory, such as shaggy correction, as the image processing, for example, the LEDA controller 39 includes a line memory for the image processor 72. The image processor 72 can not only perform image processing on the print data from the PC 50 but also generate predetermined image data (for example, image data of the positional deviation correction pattern image) in accordance with a direction from the controller 30.

The skew corrector 73 records the image data transferred from the image processor 72 line by line in the line memories 74-0 to 74-I sequentially and reads out the image data in the line memory 74 while switching the line memory 74 as a reading target among the line memories 74-0 to 74-I in accordance with image positions. With this, the skew corrector 73 performs skew correction and transmits the image data to the LEDA heads 11 line by line.

It is to be noted that a line cycle when the skew corrector 73 reads the image data corresponds to 1/N (N is a natural number) of a line cycle when the skew corrector 73 writes the image data. When the skew corrector 73 reads out the image data from the line memories 74-0 to 74-I, the skew corrector 73 reads the same image data from one line memory 74 continuously by N times so as to perform density-multiplication processing of increasing the resolution of the image data in the sub-scanning direction by N-fold. The data on which the skew correction and the density-multiplication processing have been performed is transferred to the LEDA heads 11. The controller 30 changes a transfer speed (line cycle) at this time so as to adjust the image formation speed.

Furthermore, data array needs to be converted based on wirings of the LEDA heads 11 depending on the types of the LEDA heads 11. When the conversion of the array is performed for the lines overall, the LEDA controller 39 includes a line memory for array conversion. Then, the image data after the skew correction is array-converted on the line memory and is transferred to the LEDA heads 11 line by line.

The LEDA heads 11 emit light to form the electrostatic latent images based on the image data transferred from the skew corrector 73 line by line. It is to be noted that in the embodiment, the skew corrector 73 has performed the density-multiplication processing, so that the LEDA heads 11 can form the electrostatic latent images while making the resolution of the image data in the sub-scanning direction higher, and can control gradation and positioning finely.

Figure 5:
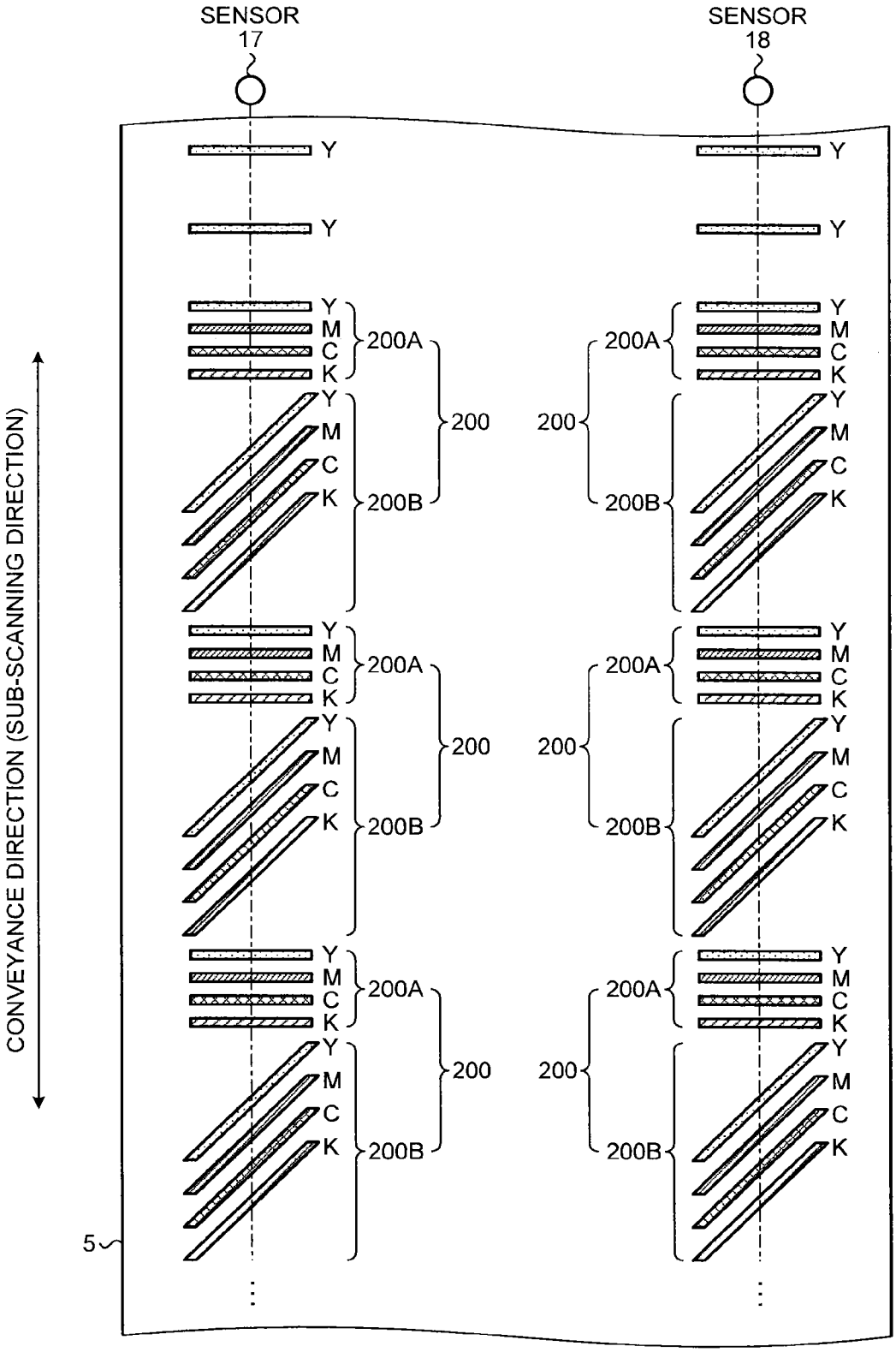
FIG. 5 is a view illustrating an example of a positional deviation correction pattern image formed on a carriage belt.

FIG. 5 is a view illustrating an example of the positional deviation correction pattern image. In the embodiment, the image forming units 6 form the positional deviation correction pattern image on the carriage belt 5 driven at a predetermined speed under control by the controller 30. To be more specific, the image forming units 6 form ladder patterns 200, 200 and the like as illustrated in FIG. 5 on the carriage belt driven at the predetermined speed. Each ladder pattern 200 is formed by combining a transverse line pattern 200A and an oblique line pattern 200B. Lines of the respective colors of Y, M, C, and K extending in parallel with the main-scanning direction are arranged at a regular interval along the sub-scanning direction on the transverse line pattern 200A. Lines of the respective colors of Y, M, C, and K extending at an angle of 45° with respective to the sub-scanning direction are arranged at a regular interval along the sub-scanning direction on the oblique line pattern 200B. Hereinafter, each of the lines of the respective colors constituting the ladder patterns 200 is referred to as a toner mark in some cases. That is to say, one (one set of) ladder pattern 200 can be also considered to be constituted by the assembly of eight toner marks. In the example of FIG. 5, a row of the ladder patterns 200 corresponding to the sensor 17 and a row of the ladder patterns 200 corresponding to the sensor 18 are formed on the carriage belt 5.

Furthermore, in the example of FIG. 5, detection timing correction patterns 110 are formed on head portions of the row of the ladder patterns 200 corresponding to the sensor 17 and the row of the ladder patterns 200 corresponding to the sensor 18. Two lines of the color of Y extending in parallel with the main-scanning direction are arranged on each of the detection timing correction patterns 110 at an equal interval along the sub-scanning direction. In this example, the positional deviation correction pattern image includes the detection timing correction patterns 110 and the ladder patterns 200 but may not include the detection timing correction patterns 110.

The sensors 17 and 18 detect the detection timing correction patterns 110 immediately before detecting the ladder patterns 200. The controller 30 calculates a time until the detection timing correction patterns 110 reach to detection positions by the sensors 17 and 18 from the start of image formation (exposure) of the patterns. Then, the controller 30 calculates a difference between a theoretical value and the time calculated actually and controls the LEDA controller 39 so as to eliminate the difference. This enables the sensors 17 and 18 to detect the ladder patterns 200 at appropriate timings. Furthermore, the controller 30 can also correct a leading end of the sheet and image writing entry positions for the respective colors from the detection results of the detection timing correction patterns 110. Deviation amounts of the image writing entry positions are generated by deviation amounts due to tolerance of incident angles of the LEDA/laser beams on the photosensitive drums 9 and deviation amounts due to change of a conveying speed of the carriage belt 5. The deviations appear on the detection results of the detection timing correction patterns 110, so that the image wiring entry positions can be corrected by detecting the detection timing correction patterns 110.

The patterns (Y) on a first station are used for the detection timing correction patterns 110, so that the conveyance distances to the detection positions by the sensors are long. This increases an influence of the error of the belt and the like so as to increase a correction effect. Alternatively, if the color of K is used for the detection timing correction patterns 110, the detection error is reduced so as to improve correction accuracy. Furthermore, each detection timing correction pattern 110 may be one set of transverse line patterns in which lines of the respective colors of C, M, Y, and K extending in parallel with the main-scanning direction are arranged at an equal interval along the sub-scanning direction. Each detection timing correction pattern 110 may be the transverse line pattern 200A on one set of the ladder pattern 200 or may be one set of the ladder pattern 200.

Described is an example of positional deviation correction that can be applied to the embodiment. In this example, the controller 30 measures an interval between adjacent toner marks constituting the transverse line pattern 200A of the above-mentioned ladder pattern 200, the respective toner marks of the transverse line pattern 200A, and the respective toner marks of the oblique line pattern 200B so as to calculate a positional deviation amount to be used for the positional deviation correction.

In this example, the controller 30 samples the detection result (A/D-converted data) by the detector 40 for the respective toner marks constituting the transverse line pattern 200A and the oblique line pattern 200B at a constant sampling cycle to measure a time interval at which the respective toner marks of the transverse line pattern 200A and the oblique line pattern 200B have been detected. With this, the controller 30 can acquire the distance between the adjacent toner marks constituting the transverse line pattern 200A and the oblique line pattern 200B. Furthermore, the controller 30 measures the distances between the toner marks of the same colors in the transverse line pattern 200A and the oblique line pattern 200B so as to compare the distances for the colors with one another. This makes it possible to calculate the positional deviation amounts.

Figure 6:
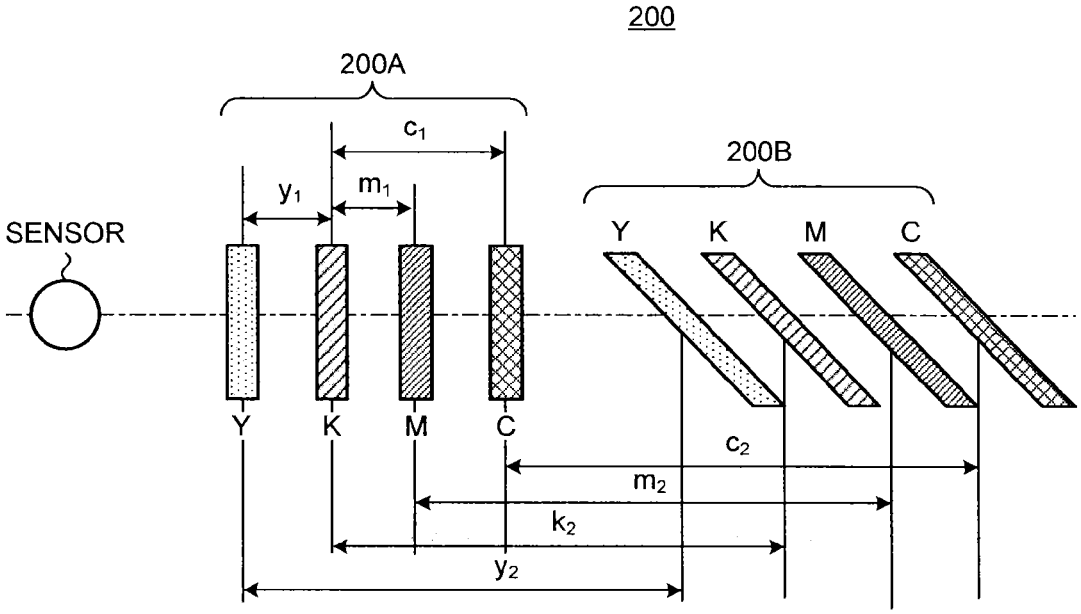
FIG. 6 is a view for explaining an example of a method of calculating a positional deviation amount.

Described is the calculation of the positional deviation amount more in detail with reference FIG. 6. In order to calculate the positional deviation amounts in the sub-scanning direction, pattern intervals ($y_1$, $m_1$, $c_1$) between the color of K as a reference color and other colors of Y, M, and C are measured by using the transverse line pattern 200A. Then, the measured results and ideal distances between the reference color and the respective colors are compared so as to calculate the positional deviation amounts in the sub-scanning direction. As the values of the ideal distances, values adjusted and measured at the time of shipping, for example, are considered to be stored in a non-volatile storage device (not illustrated) or the like previously.

In order to calculate the positional deviation amounts in the main-scanning direction, intervals ($y_2$, $k_2$, $m_2$, and $c_2$) between the respective toner marks of the transverse line pattern 200A and the respective toner marks of the oblique line pattern 200B for the respective colors are measured. The respective toner marks of the oblique line pattern 200B are formed at an angle of 45° with respect to the main-scanning direction, so that the differences in the measured interval between the reference color (color of K) and other colors of Y, M, and C correspond to the positional deviation amounts in the main-scanning direction for the respective colors of Y, M, and C. For example, the positional deviation in the main-scanning direction for the color of Y is obtained by $k_2$ minus $y_2$. As described above, the positional deviation amounts in the sub-scanning direction and the main-scanning direction for the respective colors can be acquired by using the ladder pattern 200.

The calculation processing of the positional deviation amounts can be executed by using at least one ladder pattern 200, for example. Furthermore, the positional deviation amounts for the respective colors are calculated by using a plurality of ladder patterns 200, for example, so as to perform the positional deviation correction processing with higher accuracy. For example, it is considered that statistical processing such as average value processing is performed on the positional deviation amounts calculated by using the ladder patterns 200 so as to calculate the positional deviation amounts for the respective colors.

The controller 30 controls the positional deviation correction processing by the LEDA controller 39 (image processor 72) by using the positional deviation amounts calculated as described above. Various well-known techniques can be used as the positional deviation correction method. For example, the LEDA controller 39 (image processor 72) can also perform the positional deviation correction processing by controlling lightening of the LEDA heads 11Y, 11M, 11C, and 11K based on the calculated positional deviation amounts for each pixel to control the positions and timings of optical writing onto the photosensitive drums 9Y, 9M, 9C, and 9K under control by the controller 30. In the embodiment, the positional deviation correction in the sub-canning direction is performed by using the detection result of the transverse line pattern 200A only while the positional deviation correction in the main-scanning direction is performed by using the detection result of the transverse line pattern 200A and the detection result of the oblique line pattern 200B.

Figure 7:
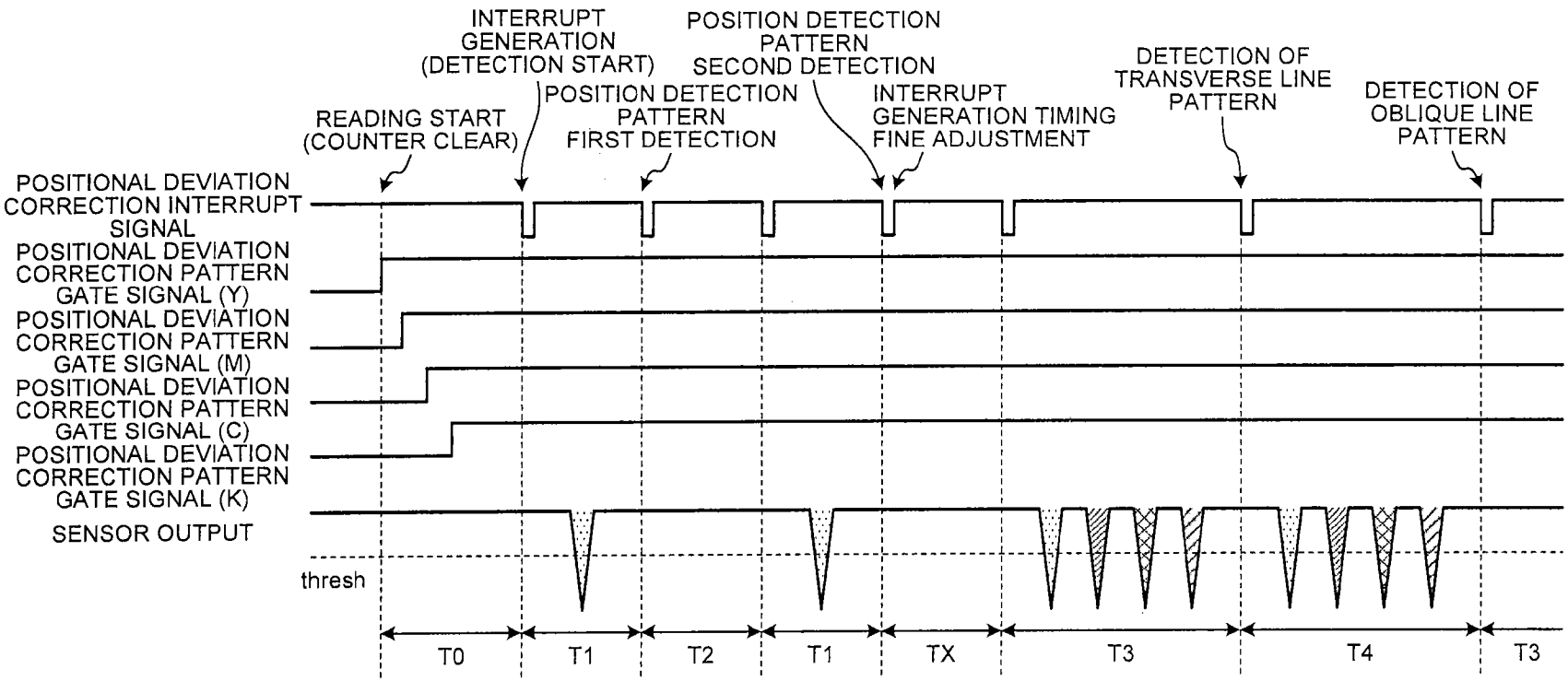
FIG. 7 is a timing chart for explaining a timing at which the positional deviation correction pattern image is detected.

The following describes, with reference to FIG. 7, the timing at which the positional deviation correction pattern image formed on the carriage belt 5 is detected. First, a pattern detection counter is reset at the same time as the start (gate signal assert) of image formation of the positional deviation correction pattern image. Next, the controller 30 sets a timing T0 (corresponding to a position several mm before the position at which the first transverse line pattern of the color of Y constituting the detection timing correction pattern 110 is detected) at which an initial interrupt signal is to be generated, generates the interrupt signal when reaching the timing T0, and resets the counter, again, at the same time. Furthermore, the controller 30 sets a timing T1 at which a subsequent interrupt signal is generated.

The first transverse line pattern of the color of Y on the detection timing correction pattern 110 is detected by the sensor 17 or 18 before reaching the timing T1, so that an output signal from the sensor 17 or 18 exceeds a threshold. The counter value at this time is stored in a timing storage register (not illustrated). The interrupt signal is generated when reaching the timing T1, so that the controller 30 reads the timing storage register so as to acquire detection timing information of the first transverse line pattern of the color of Y on the detection timing correction pattern 110. Then, the controller 30 sets a timing T2 at which a subsequent interrupt signal is generated. The controller 30 repeats these pieces of processing twice.

After the second transverse line pattern of the color of Y on the detection timing correction pattern 110 has been detected, the controller 30 obtains a difference between the ideal detection timing and the actual detection timing based on the detection timing information of the first transverse line pattern of the color of Y and the detection timing information of the second transverse line pattern of the color of Y. The controller 30 calculates and sets a timing TX at which a subsequent interrupt signal is generated based on the difference. This makes it possible to generate interrupt signals at appropriate timings when the transverse line patterns 200A and the oblique line patterns 200B of the ladder patterns 200 are detected.

When reaching the timing TX, the controller 30 generates the subsequent interrupt signal. Thereafter, the controller 30 sets an interrupt timing T3 and an interrupt timing T4 repeatedly so as to acquire pattern detection information. The interrupt timing T3 is a timing for defining a period in which a detection result of the transverse line pattern 200A of the ladder pattern 200 is acquired (loaded in the storage unit 35). The interrupt timing T4 is a timing for defining a period in which a detection result of the oblique line pattern 200B is acquired. The interrupt intervals such as T0 and T1, the width of the patterns (toner marks), and the image formation speed at which the patterns are generated are determined comprehensively based on the printing speed of the image forming apparatus 100, the conveying speed of the carriage belt 5, the sampling cycle, and the like.

Figure 8:
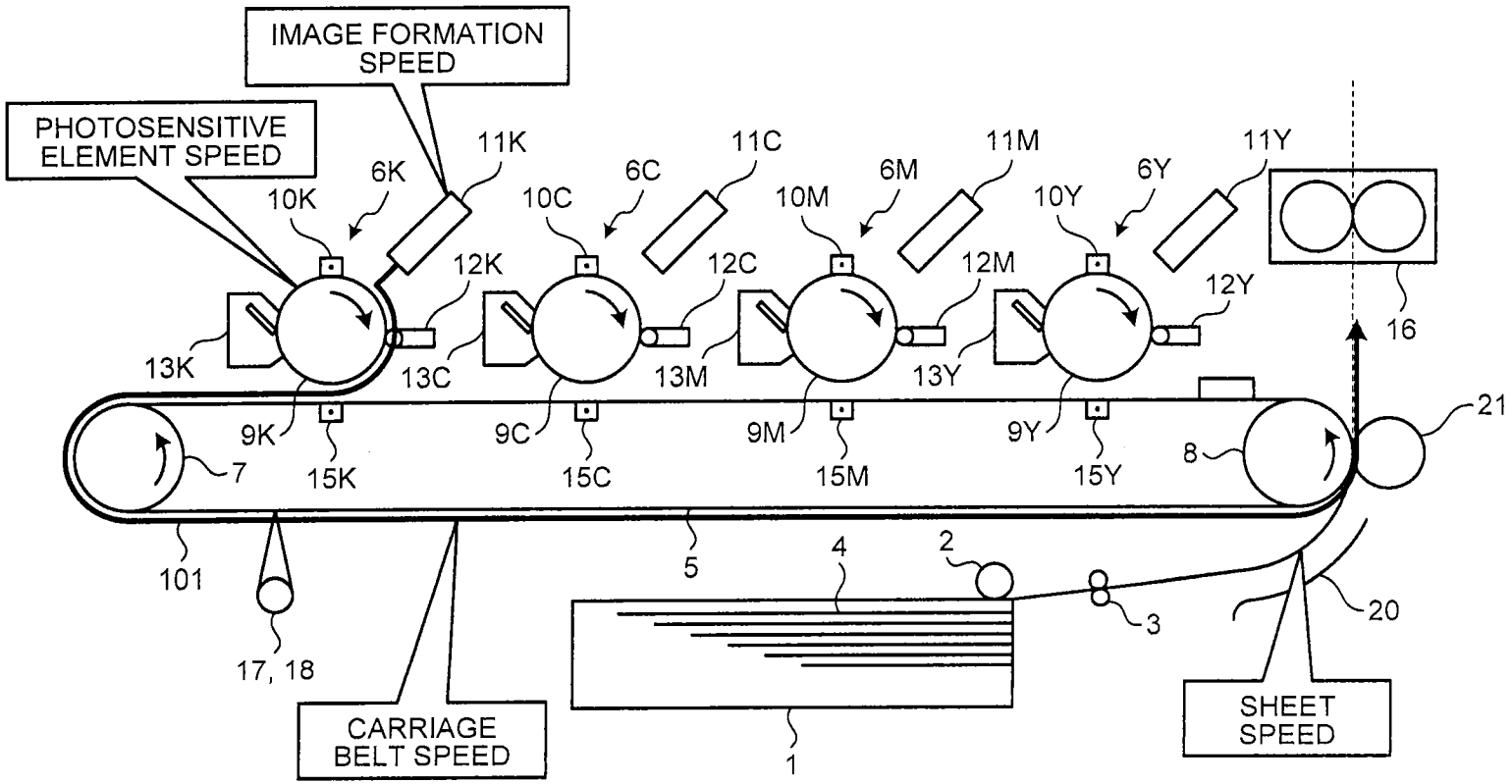
FIG. 8 is a view for explaining an ideal image formation speed and an actual image formation speed.

Next, described is the ideal image formation speed and the actual image formation speed with reference to FIG. 8. The image formation speed is a speed at which an image is formed. To be more specific, the image formation speed indicates a speed at which the electrostatic latent images are formed on the photosensitive drums 9 (optical writing speed by the LEDA controller 39). For the convenience of explanation, in FIG. 8, described is the image forming apparatus employing a system in which the toner images formed on the intermediate transfer belt 5 are transferred onto the recording medium such as the sheet 4 as an example. When printing is performed, the toner images pass through a path 101 as indicated by an arrow in FIG. 8. FIG. 8 illustrates explanation and the path for only the image forming unit 6K at the most-downstream side. In this case, the size of an image (print image) to be formed on the sheet 4 finally in the sub-scanning direction depends on the image formation speed, the driving speed of the photosensitive drums 9 (photosensitive element speed), the conveying speed of the intermediate transfer belt 5 (the carriage belt speed), the conveying speed of the sheet 4 (sheet speed), and the like. In the image forming apparatus, these speeds are set before printing is started by defining any print reference. For example, as the print reference, the number of print sheets per unit time (for example, one minute) (that is, speed at which printing is performed) is defined. In this case, the image formation speed, the photosensitive element speed, the carriage belt speed, and the sheet speed can be set so as to satisfy the print reference.

Before the printing is started, the image formation speed calculated in accordance with the previously defined print reference is referred to as the ideal image formation speed. On the other hand, when the printing has been started, an image formation speed changed so as to satisfy the print reference because the print reference cannot be satisfied for some reason is referred to as the actual image formation speed. For example, the above-mentioned controller 30 has a function of changing the respective speeds so as to satisfy the reference when the number of print sheets per unit time is smaller than the reference after the printing has been started.

Figure 9:
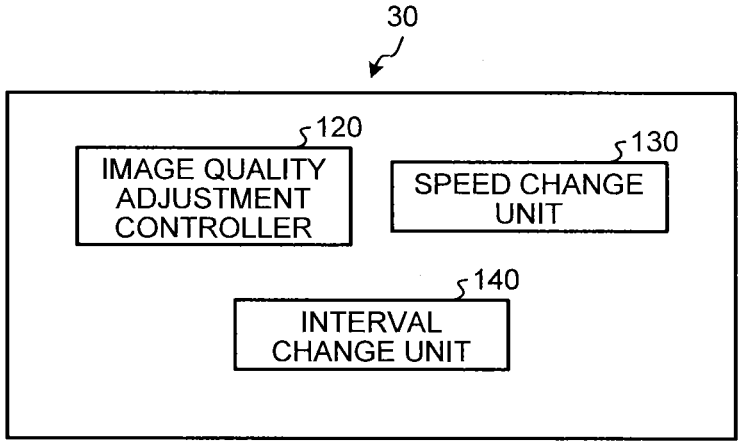
FIG. 9 is a diagram illustrating an example of functions of a controller.

FIG. 9 is a functional block diagram illustrating an example of functions of the above-mentioned controller 30. As illustrated in FIG. 9, the controller 30 includes an image quality adjustment controller 120, a speed change unit 130, and an interval change unit 140. The image quality adjustment controller 120 controls image quality adjustment processing in accordance with the detection result by the detector 40. In the embodiment, the image quality adjustment controller 120 controls the positional deviation correction processing by the LEDA controller 39 (image processor 72) in accordance with the detection result of the positional deviation correction pattern image by the detector 40.

The speed change unit 130 changes the image formation speed so as to satisfy the previously defined print reference. The speed change unit 130 changes not only the image formation speed but the above-mentioned photosensitive element speed, carriage belt speed, and sheet speed so as to satisfy the previously defined print reference. The interval change unit 140 changes an interval (in the embodiment, interrupt interval) at which the detector 40 acquires a detection result based on the image formation speed before changed by the speed change unit 130 and the image formation speed after changed. The interrupt interval is measured by a counter (not illustrated).

Although the respective functions of the above-mentioned image quality adjustment controller 120, speed change unit 130, and interval change unit 140 are made to operate when the CPU of the controller 30 loads and executes computer programs stored in the ROM and the like on the RAM, the configuration is not limited thereto. For example, a configuration in which at least a part of the above-mentioned image quality adjustment controller 120, speed change unit 130, and interval change unit 140 is made to operate on a dedicated hardware circuit may be employed.

Figure 10:
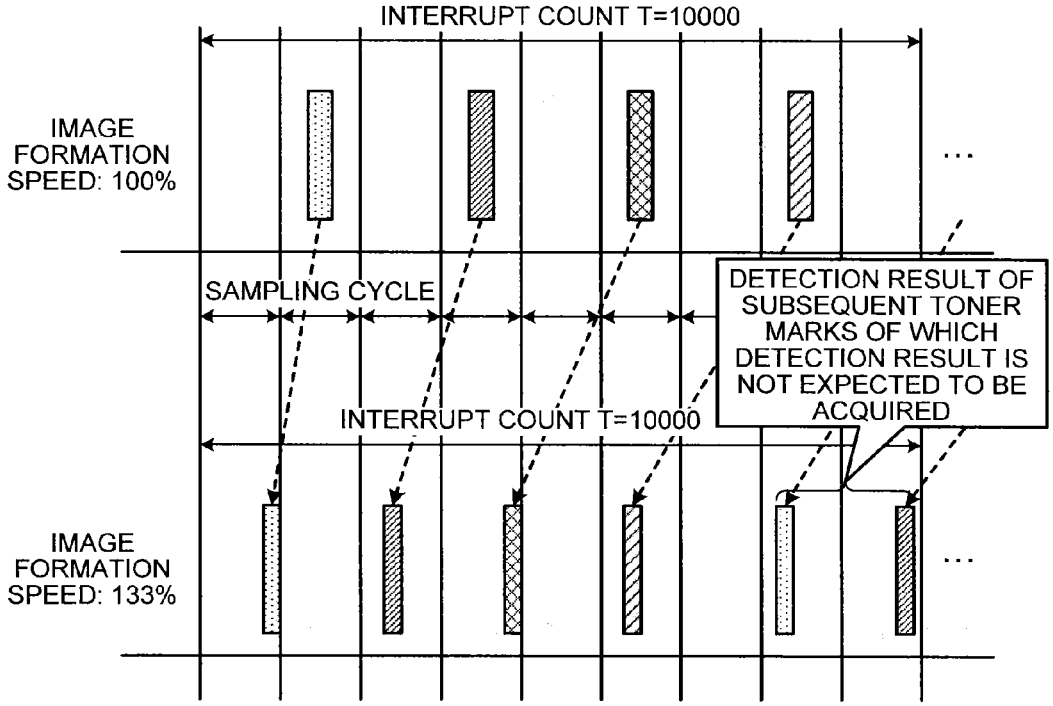
FIG. 10 is a view for explaining operations in a comparison example.

As a comparison example with respect to the embodiment, expected is a configuration in which the interrupt interval is not changed (the interval change unit 140 is not provided) even if the image formation speed is changed. In the comparison example, the interrupt interval is set while the case where the image formation speed is an ideal value is expected. In the example of FIG. 10, a count value T of 10000 is set as the interrupt interval at which the detection result of the transverse line pattern 200A of the above-mentioned ladder pattern 200 is acquired. As illustrated in FIG. 10, when the actual image formation speed is equal to the ideal value (expressed as "100%" here), the detection result of the respective toner marks of the transverse line pattern 200A is within the interrupt interval normally. In other words, in the interrupt interval at which the detection result of the transverse line pattern 200A is acquired, only the toner marks of the transverse line pattern 200A are detected.

When the value of the actual image formation speed is larger than the ideal value, for example, when the actual image formation speed has been changed to "133%", the size (length) of the positional deviation correction pattern image formed on the image carrier such as the carriage belt in the sub-scanning direction is decreased to be approximately 75% in comparison with the case where the value of the image formation speed is the ideal value. This arises a problem that the subsequent toner mark (for example, toner mark of the oblique line pattern 200B) of which detection result is not expected to be acquired is also acquired undesirably in the interrupt interval at which the detection result of the transverse line pattern 200A is to be acquired and the transverse line pattern 200A cannot be acquired normally.

Furthermore, when the value of the actual image formation speed has been changed to a value smaller than the ideal value, the size of the positional deviation correction pattern image in the sub-scanning direction is increased in comparison with the case where the value of the image formation speed is the ideal value. In this case, the toner marks of the transverse line pattern 200A cannot be detected in the interrupt interval at which the detection result of the transverse line pattern 200A is to be acquired in some cases, resulting in a problem that the transverse line pattern 200A cannot be acquired normally. It is to be noted that the same problems arise on the oblique line pattern 200B. In summary, in the comparison example, if the image formation speed is changed, there arises the problem that the positional deviation correction pattern image cannot be detected normally.

Figure 11:
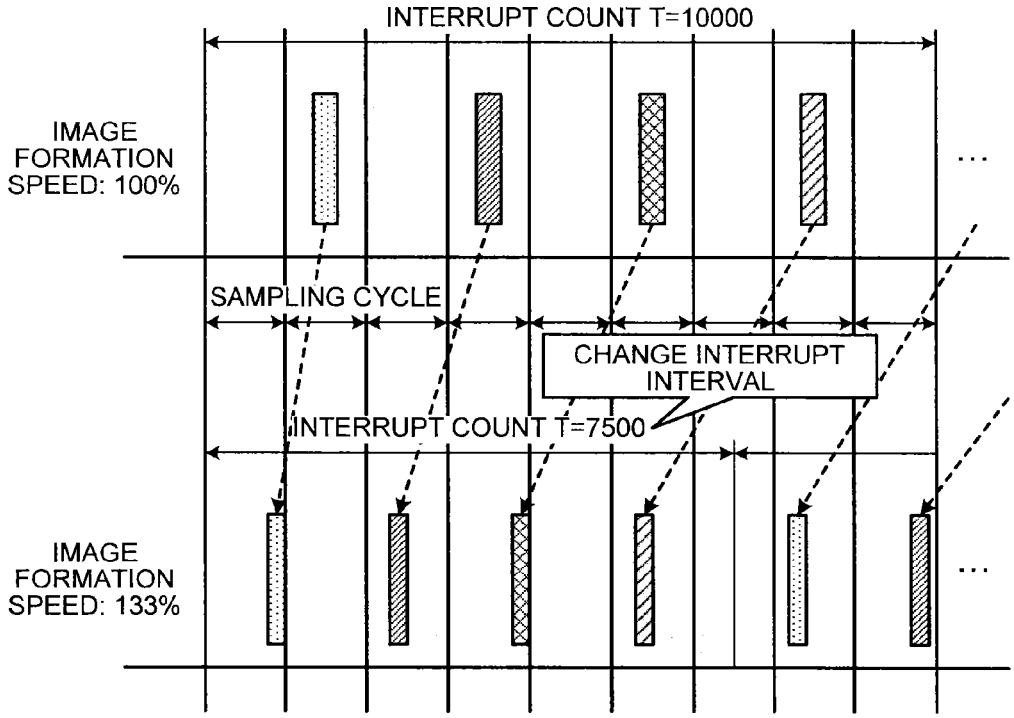
FIG. 11 is a view for explaining operations in the embodiment.

In order to solve the problem, in the embodiment, in order to detect the positional deviation correction pattern image normally even if the image formation speed is changed, as illustrated in FIG. 11, the controller 30 (interval change unit 140) changes the interrupt interval in accordance with the change amount of the image formation speed. To be more specific, when the image formation speed after changed by the speed change unit 130 is larger than the image formation speed before changed, the interval change unit 140 changes the interrupt interval to be a value smaller than that before the image formation speed is changed. When the image formation speed after changed is smaller than the image formation speed before changed, the interval change unit 140 changes the interrupt interval to be a value larger than that before the image formation speed is changed.

In the example of FIG. 11, because the actual image formation speed is changed to "133%", which is larger than the ideal value, the interval change unit 140 changes the interrupt interval to be a value smaller than that before the image formation speed is changed. To be more specific, with the increase of the image formation speed from the ideal value ("100%") to "133%", the size of the positional deviation correction pattern image to be formed on the image carrier such as the carriage belt in the sub-scanning direction is decreased to approximately 75%. In response thereto, the interval change unit 140 decreases the time length of the interrupt interval to be 75% in comparison with that before the image formation speed is changed in accordance with the change rate of the size of the positional deviation correction pattern image in the sub-scanning direction. With this, as illustrated in FIG. 11, the interrupt interval at which the detection result of the transverse line pattern 200A is acquired is decreased to a "count value T of 7500" from the "count value T of 10000". This makes it possible to detect the respective toner marks of the transverse line pattern 200A normally without detecting the subsequent toner mark of which detection result is not expected to be acquired.

Described has been the example in which the interrupt interval is changed when the image formation speed has been changed from the ideal value above. A situation where the interval change unit 140 changes the interrupt interval is not limited thereto. For example, also expected is a case where the print reference is not satisfied for some reason during printing after the image formation speed has been changed from the ideal value. In this case, the speed change unit 130 changes the image formation speed and the like, again, so as to satisfy the print reference. The interval change unit 140 can also change the interrupt interval in accordance with the change amount between the image formation speed (image formation speed after the second change) after changed by the speed change unit 130 and the image formation speed (image formation speed after the first change) before changed. In other words, it is sufficient that the interval change unit 140 has a function of changing the interrupt interval (interval at which the detector 40 acquires the detection result) in accordance with the change amount between the image formation speed before changed by the speed change unit 130 and the image formation speed after changed.

In the above-mentioned embodiment, the image forming units 6 form the positional deviation correction pattern image on the image carrier such as the carriage belt and the intermediate transfer belt under control by the controller 30. The controller 30 (image quality adjustment controller 120) controls the positional deviation correction processing in accordance with a detection result by the detector 40. The invention, however, is not limited thereto. For example, the image forming units 6 may form a density deviation correction pattern image to be used for correcting densities of images of a plurality of colors that are formed on the recording medium such as the sheet 4 on the image carrier such as the carriage belt and the intermediate transfer belt under control by the controller 30. In this case, the controller 30 (image quality adjustment controller 120) may control the density correction processing in accordance with a detection result of the density deviation correction pattern image by the detector 40. The functions of the above-mentioned controller 30 (speed change unit 130, interval change unit 140) can be also applied to the configuration. That is to say, an "image quality adjustment pattern image" in the scope of the invention is not limited to the positional deviation correction pattern image and may be the density deviation correction pattern image, for example.

Second Embodiment

Next, described is a second embodiment of the present invention. The second embodiment is different from the above-mentioned first embodiment in a point that the following function (size change unit) is provided instead of the above-mentioned interval change unit 140. That is, in the second embodiment, the function (size change unit) of changing the size of the positional deviation correction pattern image (an example of the image quality adjustment pattern image) in the sub-scanning direction in accordance with the change amount between the image formation speed before changed by the speed change unit 130 and the image formation speed after changed. Hereinafter, description of parts that are common to those in the first embodiment is omitted appropriately.

Figure 12:
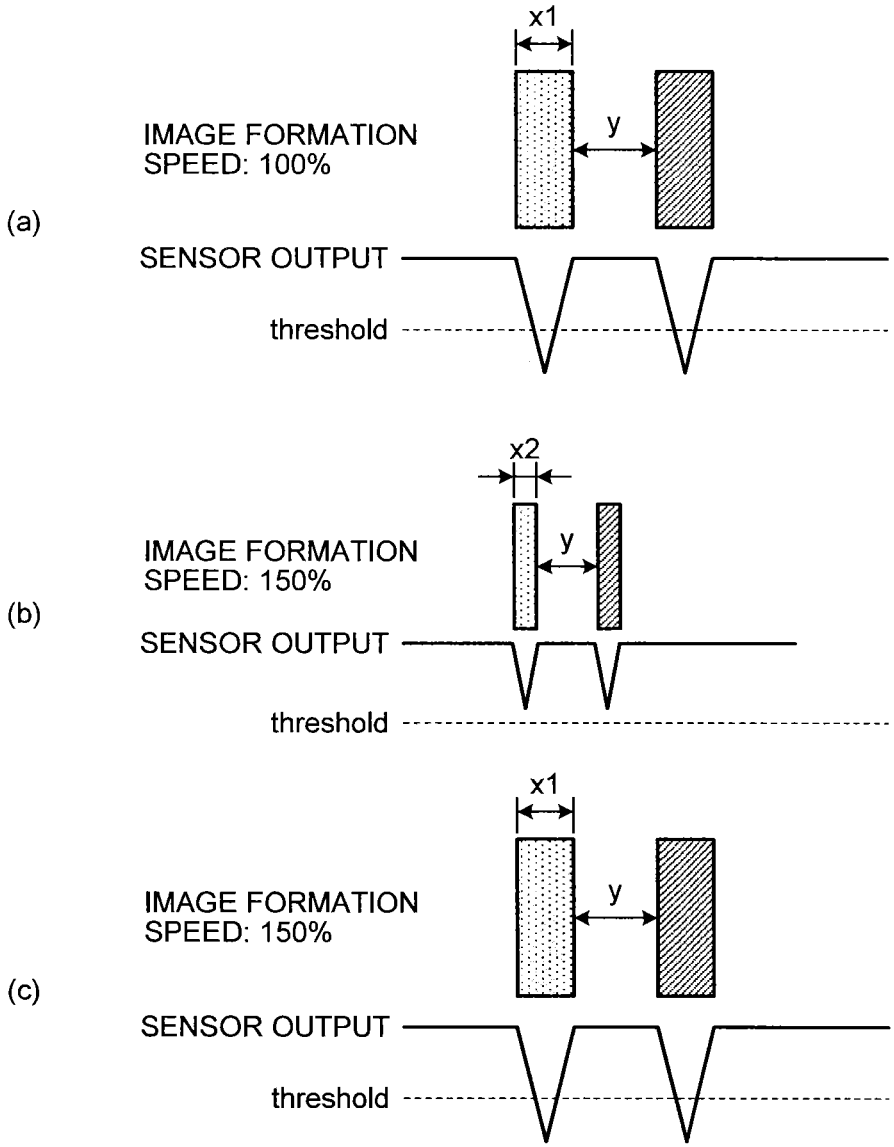
FIGS. 12(*a*) to 12(*c*) are views for explaining a state where the size of the positional deviation correction pattern image in the sub-scanning direction is changed in accordance with the image formation speed.

When the image formation speed is the ideal value ("100%"), the controller 30 sets the size of the respective toner marks in the sub-scanning direction such that the signal to be output from the sensor 17(18) when the toner marks of the above-mentioned ladder pattern 200 pass through the detection position by the sensor 17(18) exceeds a threshold at which the sensor 17(18) can detect the toner marks. In the example of FIG. 12(*a*), because the image formation speed is the ideal value, the size of the toner marks of the ladder pattern 200 formed on the image carrier such as the carriage belt 5 is a size X1 of the toner mark that can be the sensor 17(18) and the respective toner marks of the ladder pattern 200 are detected normally. That is to say, the positional deviation correction pattern image is detected normally.

As a comparison example with respect to the embodiment, expected is a configuration in which the size of the positional deviation correction pattern image in the sub-scanning direction is not changed (the above-mentioned size change unit is not provided) even if the image formation speed is changed. With the configuration, as illustrated in FIG. 12(*b*), when the speed change unit 130 has changed the image formation speed to 150% (150% from 100%), the overall positional deviation correction pattern image to be formed on the image carrier is contracted in the sub-scanning direction. A size X2 of the respective toner marks formed on the image carrier in the sub-scanning direction is smaller than the size X1 of the toner mark that can be the sensor 17(18). For this reason, the signal to be output from the sensor 17(18) when the toner marks pass through the detection position by the sensor 17(18) cannot excess the threshold and the sensor 17(18) cannot detect the toner marks. That is to say, in the comparison example, there arises a problem that if the image formation speed is changed, the positional deviation correction pattern image cannot be detected normally.

The size change unit in the embodiment changes the size of the positional deviation correction pattern image in the sub-scanning direction in accordance with the change amount between the image formation speed before changed by the speed change unit 130 and the image formation speed after changed. To be more specific, when the image formation speed after changed by the speed change unit 130 is larger than the image formation speed before changed, the size change unit enlarges the size of the positional deviation correction pattern image in the sub-scanning direction to be larger than that before the image formation speed is changed. On the other hand, when the image formation speed after changed is smaller than the image formation speed before changed, the size change unit contracts the size of the positional deviation correction pattern image in the sub-scanning direction to be smaller than that before the image formation speed is changed. That is to say, the change amount of the size of the positional deviation correction pattern image by the size change unit is proportionate to the change amount of the image formation speed by the speed change unit 130.

For example, as illustrated in FIG. 12(*c*), when the speed change unit 130 has changed the image formation speed to 150% (150% from 100%), the overall positional deviation correction pattern image to be formed on the image carrier is contracted in the sub-scanning direction. In this case, the size change unit enlarges the size of the respective toner marks of the ladder pattern 200 in the sub-scanning direction to be larger than that before the image formation speed is changed to 150%. With this, the size of the toner marks to be formed on the image carrier in the sub-scanning direction can be also changed to be equal to or larger than the size X1 of the toner marks that can be detected by the sensor 17(18). This makes it possible to detect the positional deviation correction pattern image normally even if the image formation speed is changed.

In the embodiment, although the functions of the above-mentioned size change unit are made to operate when the CPU of the controller 30 loads and executes computer programs stored in the ROM and the like on the RAM (that is, the controller 30 has the functions of the size change unit), the configuration is not limited thereto. For example, a configuration in which the functions of the above-mentioned size change unit are made to operate on a dedicated hardware circuit may be employed. Furthermore, in the same manner as the above-mentioned first embodiment, the image forming units 6 may form a density deviation correction pattern image to be used for correcting densities of images of a plurality of colors that are formed on the recording medium such as the sheet 4 on the image carrier such as the carriage belt and the intermediate transfer belt under control by the controller 30. The image quality adjustment controller 120 may control the density correction processing in accordance with the detection result of the density deviation correction pattern image by the detector 40. The functions of the above-mentioned size change unit can be also applied to the configuration.

Computer programs to be executed in the image forming apparatus in the above-mentioned embodiments (computer programs to be executed by the CPU of the controller 30) may be configured to be provided by being recorded in a recording medium that can be read by a computer, such as a compact disc read only memory (CD-ROM), a flexible disk (FD), a CD recordable (CD-R), or a digital versatile disk (DVD), in an installable or executable file format.

The programs to be executed in the image forming apparatus in the above-mentioned embodiments may be configured to be provided by being stored on a computer connected to network such as the Internet and being downloaded through the network. Alternatively, the programs to be executed in the image forming apparatus in the above-mentioned embodiments may be configured to be provided or distributed through network such as the Internet.

According to the present invention, the image quality adjustment pattern image can be detected normally even if the image formation speed is changed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image former configured to form an image quality adjustment pattern image on an image carrier to be driven at a predetermined speed;

a detector configured to detect the image quality adjustment pattern image;

an image quality adjustment controller configured to control image quality adjustment processing in accordance with a detection result by the detector;

a speed changer configured to change an image formation speed indicating a speed at which an image is formed; and an interval changer configured to change, when the speed changer changes the image formation speed and while the image carrier is driven at the predetermined speed, an interval at which the detector acquires the detection result in accordance with a change amount between the image formation speed before being changed by the speed changer and the image formation speed after being changed by the speed changer.

2. The image forming apparatus according to claim 1, wherein when the image formation speed after being changed by the speed changer is larger than the image formation speed before being changed, the interval changer changes the interval to be a first value smaller than a second value before the image formation speed is changed, and when the image formation speed after being changed is smaller than the image formation speed before being changed, the interval changer changes the interval to be a third value larger than the second value before the image formation speed is changed.

3. The image forming apparatus according to claim 1, wherein the image former is configured to form images of a plurality of colors on the image carrier or a recording medium to be driven at the predetermined speed in a superimposed manner, the image quality adjustment pattern image is a positional deviation correction pattern image to be used for correcting positional deviations of the images of the plurality of colors, and the image quality adjustment controller is configured to control positional deviation correction processing in accordance with the detection result of the positional deviation correction pattern image by the detector.

4. The image forming apparatus according to claim 1, wherein the image former is configured to form images of a plurality of colors on the image carrier or a recording medium to be driven at the predetermined speed in a superimposed manner, the image quality adjustment pattern image is a density deviation correction pattern image to be used for correcting densities of the images of the plurality of colors, and the image quality adjustment controller is configured to control density correction processing in accordance with the detection result of the density deviation correction pattern image by the detector.

5. The image forming apparatus according to claim 1, wherein a size of the image quality adjustment pattern image is changed in accordance with the change amount.

6. The image forming apparatus according to claim 5, wherein a first percentage change in the size of the image quality adjustment pattern image equals a second percentage change in the interval.

7. The image forming apparatus according to claim 5, wherein the change in size of the image quality adjustment pattern image is directly proportional to the change in the interval.

8. The image forming apparatus according to claim 5, wherein each of the change in size of the image quality adjustment pattern image and the change in the interval is inversely proportional to the change in the image formation speed.

9. An image forming apparatus comprising:

an image former configured to form an image quality adjustment pattern image on an image carrier to be driven at a predetermined speed;

a detector configured to detect the image quality adjustment pattern image;

an image quality adjustment controller configured to control image quality adjustment processing in accordance with a detection result by the detector;

a speed changer configured to change an image formation speed indicating a speed at which an image is formed;

a size changer configured to change a size of the image quality adjustment pattern image in a sub-scanning direction in accordance with a change amount between the image formation speed before being changed by the speed changer and the image formation speed after being changed by the speed changer; and an interval changer configured to change, when the speed changer changes the image formation speed and while the image carrier is driven at the predetermined speed, an interval at which the detector acquires the detection result in accordance with the change amount between the image formation speed before being changed by the speed changer and the image formation speed after being changed by the speed changer.

* * * * *